United States Patent [19]

Paul

[11] 4,391,345

[45] Jul. 5, 1983

[54] ELEVATABLE SCAFFOLD

[76] Inventor: Jim N. Paul, 2737 S. Broadway, Tyler, Tex. 75701

[21] Appl. No.: 234,353

[22] Filed: Feb. 13, 1981

[51] Int. Cl.[3] ..... E04G 1/22; B66F 3/22

[52] U.S. Cl. ..... 182/141; 182/63; 187/18; 254/122

[58] Field of Search ..... 182/63, 69, 141, 148; 187/18; 254/122, 9 R, 9 B, 9 C; 74/516, 517

[56] References Cited

U.S. PATENT DOCUMENTS 3,373,844 3/1968 Schafer ..... 182/69

*Primary Examiner*—Reinaldo P. Machado
*Assistant Examiner*—Alvin Chin-Shue
*Attorney, Agent, or Firm*—Bill B. Berryhill

[57] ABSTRACT

An elevatable scaffold including a base and a platform connected therebetween by a lift assembly movable between a collapsed position and extended positions for elevating the platform above the base. The lift assembly may include a series of elongated structural assemblies each pivoted at one end and the middle thereof to some other structural assembly in the series; a cable passing substantially parallel with some of the structural assemblies and between the ends of mutually pivoted structural assemblies, one end of the cable being secured at the end of one of the structural assemblies; and a winch assembly mounted on the base and on which the other end of the cable is wound so that operation of the winch assembly may effect elevating of the platform by further winding of the cable thereon. The lift assembly may also include a sheave assembly mounted near the midpoint of one of the lowermost of the elongated structural assemblies engageable by the cable when the lift structure is in its collapsed position for providing mechanical advantage in initiating movement of the lift structure toward the extended positions.

16 Claims, 7 Drawing Figures

ELEVATABLE SCAFFOLD

BACKGROUND OF THE INVENTION

1. Field of the Invention

The present invention pertains to elevatable platforms or scaffolds by which workers may be positioned at various elevations relative to the ground or by which materials may be lifted above the ground. Specifically, it pertains to self-propelled or self-elevated platforms or scaffolds.

2. Description of the Prior Art

There are a number of types of self-propelled or self-elevated scaffolds, platforms or lifts. In one type of scaffold, called a scissor-life, pairs of structural members are arranged in scissor or parallelogram fashion so that as the horizontal distance between the ends of the structural members are shortened, the vertical distance is increased. In the past, such scaffolds have been propelled by hydraulic cylinders attached to a base or carriage. As the hydraulic cylinders are extended, the elevation of the work platform is increased. Nearly all currently manufactured elevating scaffolds utilize hydraulic cylinders. However, due to the large forces required in such arrangements and due to the weight of the hydraulic cylinders, such scaffolds or lifts are relatively heavy and expensive.

Prior to the development of hydraulic elevating scaffolds or lifts, some cable or chain driven lifts were developed. In such lifts, a cable or chain extends from a winch along one member or tong of a scissor arrangement and from the end thereof to the end of another scissor arrangement directly thereabove. Winding of the cable or chain on the winch causes the ends of the scissor assemblies to be drawn together and forcing the platform or scaffold mounted on the scissor assemblies to be elevated. However, one of the problems in such an arrangement is the initial movement of the scissor structure from a totally collapsed position toward extended positions. In the totally collapsed position, all portions of the cable or chain are essentially in a horizontal position so that there are no vertical force components to initially lift the scissor mechanism to an extended position.

This problem has been approached in several different fashions. For example, in U.S. Pat. No. 1,078,759, an auxiliary elevating device is provided which includes a pair of blocks mounted for vertical movement in guideways. The blocks are connected by a rod so as to press on the lower tongs of the scissor mechanism. Attached to the blocks is a rope or cable which extends around a pulley and, in some manner, around a shaft. The shaft is driven by a chain and sprocket which is selectively activated by a lever and gear arrangement. When this arrangement is in gear, the cable lifts the blocks and consequently the scissor assembly until it is started on its upward movement. Then the lever is shifted and the blocks placed in a passive position. This arrangement is rather bulky and complex.

In U.S. Pat. No. 1,817,418, initial movement of the scissor mechanism from the collapsed position is accomplished by providing arms and pulleys extending from tongs or linkages. In the completely collapsed position, these arms depend downwardly so that the pulleys engage the cable in such a manner that the cable stretches or extends in a "V" form. This provides the necessary vertical forces to initiate movement of the mechanism. Once the mechanism is partially elevated, the vertical assistance is discontinued and horizontal forces take over for further elevation. However, this type of arrangement requires that the base be elevated enough to accommodate the downwardly depending arms. Therefore, the entire elevatable scaffold or lift must be elevated or permanently placed on an elevated platform such as a truck or the like.

It is apparently this problem of initiating vertical movement that has caused elevatable scaffolds or platforms to evolve toward hydraulic lift mechanisms even though such hydraulic lift platforms are relatively more bulky, heavy and expensive. Thus, there appears to be no presently commercially accepted cable driven self-elevated scaffolds.

SUMMARY OF THE INVENTION

In the present invention, an elevatable scaffold or platform is disclosed which is totally elevatable by cable, including no hydraulic mechanism. The resulting scaffold is therefore less expensive, lighter and simpler in construction and operation. The problem associated with initiating movement of such a platform is solved with the arrangement of the present invention.

The elevatable scaffold of the present invention includes a base and platform connected therebetween by a lift assembly which is movable between a collapsed position and extended positions for elevating the platform above the base. The lift assembly comprises a series of elongated structural assemblies, each pivoted at one end and the middle thereof to some other structural assembly in the series; a cable passing substantially parallel with some of the structural assemblies and between the ends of mutually pivoted structural assemblies, one end of the cable being secured at the end of one of the structural assemblies; and a winch assembly mounted on the base about which the other end of the cable is wound so that operation of the winch assembly may effect elevating of the platform by further winding of the cable thereon. The lift assembly also includes means engageable by the cable when the lift assembly is in its collapsed position for providing a mechanical advantage and initiating the movement of the lift assembly toward extended positions. The means for providing the mechanical advantage may include a sheave assembly mounted near the midpoint of one of the lowermost elongated structural assemblies and including at least one sheave member which is disposed above the base and engageable by the cable forcing a portion of the cable to assume an inclined path from the sheave member toward one end of one of the lowermost elongated structural assemblies for creating a vertical force, upon operation of the winch assembly, to initiate movement of lift structure from a collapsed position toward extended positions.

Thus, the elevatable scaffold of the present invention is operated solely by a cable and winch arrangement without any hydraulic assistance. The problem of initiating movement from a collapsed position is solved by a unique mechanism which creates a vertical force necessary for initiating such movement. The resulting elevatable scaffold is efficient and operatable from any position without hydraulic assistance and the inherent weight, bulkiness and expense of such. Many other objects and advantages of the invention will be apparent from reading the specification which follows in conjunction with the accompanying drawings.

DESCRIPTION OF A PREFERRED EMBODIMENT

Figure 1:
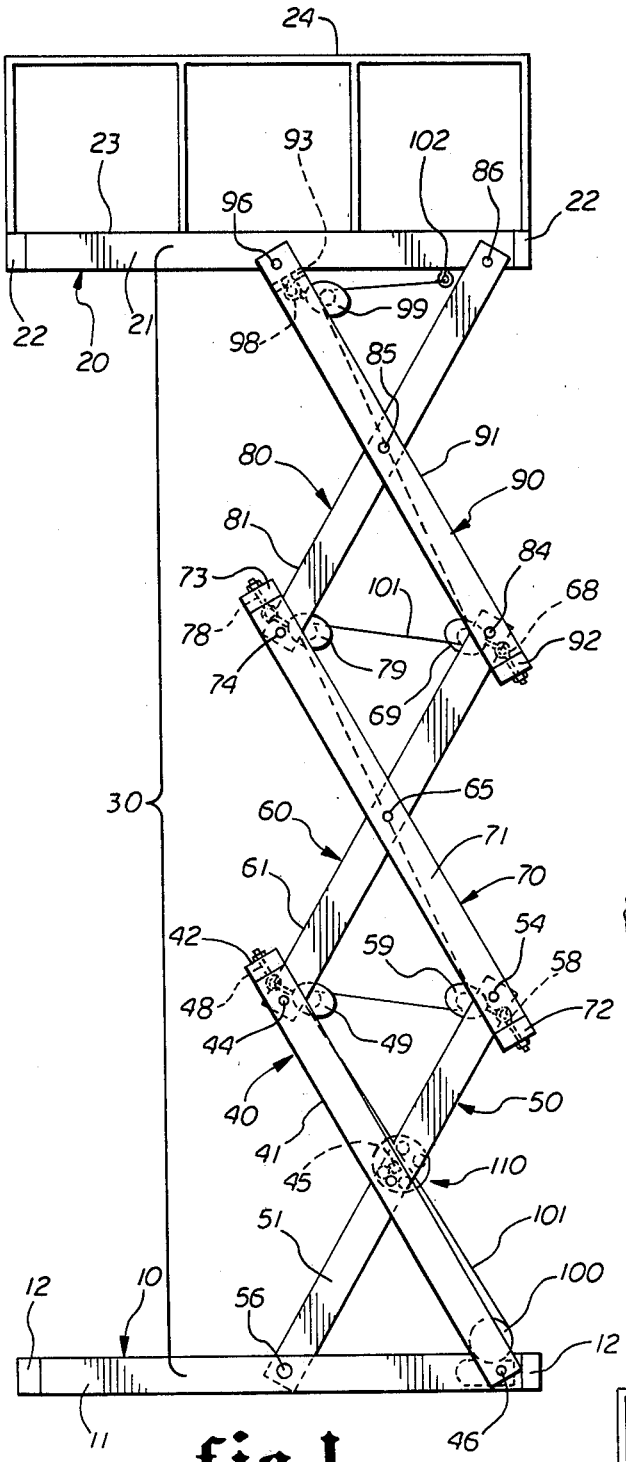
FIG. 1 is a side elevation view of an elevatable scaffold, according to a preferred embodiment of the invention, shown in an extended position.
Figure 2:
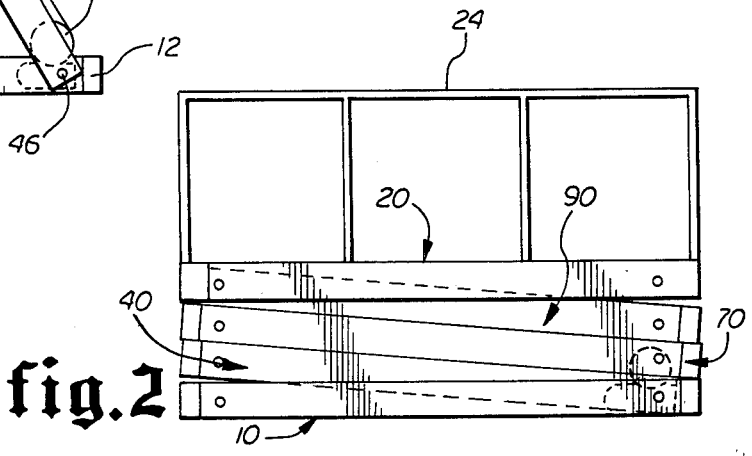
FIG. 2 is a side elevation view of an elevatable scaffold, according to a preferred embodiment of the invention, shown in a collapsed position.

Referring first to FIG. 1, the elevatable scaffold of the present invention includes a base 10 and platform 20 connected therebetween by a lift assembly 30 movable between a collapsed position, as shown in FIG. 2, and extended positions for elevating the platform 20 above the base 10. The base 10 is a rectangular assembly formed by a pair of elongated channels or structural members 11 and a pair of shorter structural members 12. These members may be welded or bolted together.

The platform 20 may also be formed by pairs of elongated structural members or channels 21 and shorter structural members 22 forming a rectangular structure on which a floor 23 and side rails 24 may be placed. The platform 20 can be used for supporting workers or materials for elevation.

The lift assembly 30 comprises a series of elongated structural assemblies 40, 50, 60, 70, 80 and 90, each pivoted at one end and the middle thereof to some other structural assembly in the series. Each of the structural assemblies 40, 50, 60, 70, 80, and 90, may form a rectangular structural of a pair of elongated tong members 41, 51, 61, 71, 81 and 91, some of the ends of which are connected by header members 42, 72, 73 and 92. End pivoting is provided by pivot connections 44, 54, 74 and 84 and midpoint pivoting by pivot connections 45, 65, and 85. The lower end of tong member 41 is pivotally connected to the base 10 at pivot connection 46 and the upper end of tong member 81 is pivotally connected to the platform 20 at pivot connection 86. The lower end of structural assembly 50 is provided with rollers 56 which ride in guideways (not shown) attached to the base 10 parallel to elongated structural members 11. Likewise, the upper end of structural assembly 90 is provided with rollers 96 which are retained in guideways (not shown) carried by the elongated structural members 21 of the platform 20. Thus, structural assembly 50 may pivot about its lower end as the roller 56 moves along the base guideway and the upper end of structural assembly 90 may pivot about roller 96 as it moves along the platform guideway.

It is easily understood that the lift assembly 30 is movable from a totally collapsed position as in FIG. 2, to extended positions such as the one shown in FIG. 1 by bringing the ends of mutually pivoted structural assemblies 50, 40, 60, 70, 80 and 90 together by some means. To accomplish this, a plurality of sheave assemblies may be attached to some of the header members 42, 72, 73, 92 and 93. The sheave assemblies may include eye bolts 48, 58, 78, 68 and 98, from which sheave blocks 49, 59, 79, 69 and 99 may depend.

The lift assembly 30 also includes an electric motor driven winch assembly 100 which is mounted on the base 10 for connection to a source of electric power. One end of a cable 101 is wrapped around the winch 100 and passes substantially parallel with some of the structural assemblies 40, 70 and between the ends of mutually pivoted structural assemblies, engaging sheave blocks 49, 59, 79, 69 and 99, the other end of the cable being secured at 102 to the platform 20 or if desired to one of the upper structural assemblies such as 80. Thus, it is seen that operation of the winch 100 by winding cable 101 thereon effects elevation of the platform 20 by extension of the lift assembly 30. Conversely, if the cable 101 is unwound from the winch assembly 100, the weight of the lift assembly 30 and platform 20 causes the scaffold to eventually assume the collapsed position of FIG. 2.

Figure 4:
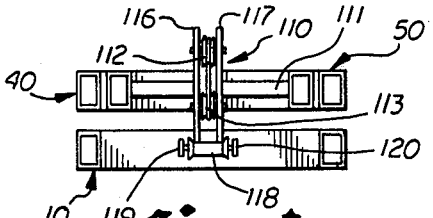
FIG. 4 is a cross-sectional view of an elevatable scaffold of the present invention, taken along line 4—4 of FIG. 3, illustrating the mechanism for providing mechanical advantage in initiating movement of the lift assembly.
Figure 3:
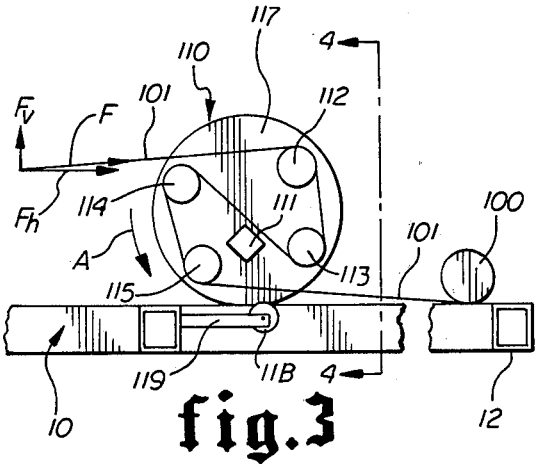
FIG. 3 is a side elevation view showing in detail a portion of the lift assembly of the elevatable scaffold of FIGS. 1 and 2 for providing a mechanical advantage in initiating the movement of the lift assembly from the collapsed position toward the extended positions.
Figure 5:
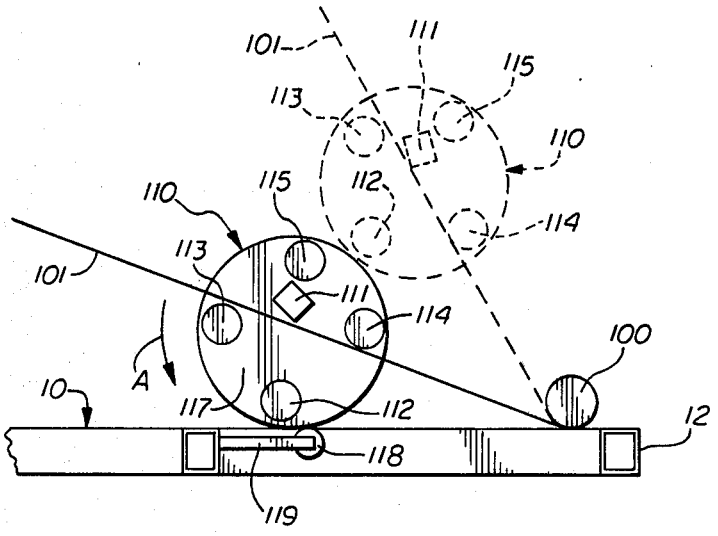
FIG. 5 is a detailed side elevation view, similar to FIG. 3 but showing relative positions of the means for providing mechanical advantage when the platform is in the extended position of FIG. 1.

As previously pointed out the problem exists in initiating movement of the scaffold from the collapsed position of FIG. 2 to the extended position of FIG. 1 in that unless some auxiliary mechanism is provided, the cable 101 will essentially be in a horizontal position providing no vertical forces to initiate upward movement. Accordingly, the scaffold of the present invention is provided with a means, a preferred embodiment of which is best shown in FIGS. 3, 4, and 5, for providing a mechanical advantage in initiating the movement of the lift assembly 30 toward extended positions. The means for providing a mechanical advantage comprises a sheave assembly 110 which is rotatingly mounted on a shaft 111 supported at the midpoint pivot 45 between the lowermost structural assemblies 40 and 50. The sheave assembly 110 comprises first, second, third and fourth sheaves 112, 113, 114 and 115, mounted between plates 116 and 117. In the collapsed position of FIGS. 2, 3, and 4, the edges of the plate members 116 and 117 act as a cam and rest on a cam follower 118 which is attached to the base 10 by brackets 119 and 120.

The cable 101 passes from the winch assembly 100 around sheaves 115, 114, 113, and 112, as shown in FIG. 3, toward engagement with the sheave block 49 at one end of the structural assembly 40. It will be noted that the sheave member 112 is disposed above the base 10, engaging the cable 101 and forcing a portion thereof to assume an inclined path from the sheave member 112 toward the sheave block 49 at the end of structural assembly 40. Thus, upon operation of the winch assembly 100, winding the cable 101 thereon, a force F is created having a horizontal force component $F_h$ and a vertical force component $F_v$ as illustrated by the force diagram at the cable 101 in FIG. 3. The vertical force component $F_v$ is sufficient to initiate upward movement of a lift assembly 30 toward extended positions. As the cable 101 continues to be wound on winch assembly 100, the sheave assembly 110, rotating about the axis of shaft 111, rotates counterclockwise as illustrated by the arrow A in FIG. 3. The edges of the plate members 116 and 117 roll on the cam follower 118 and the shaft member 111, along with the structural assemblies 40 and 50 to which the shaft is attached, moves from the lower position shown in FIG. 3 to the higher position shown (solid lines) in FIG. 5. At this point, the cable 101 assumes a straight line disposition between the winch assembly 100 and the sheave block 49, at the end of structural assembly 40. At this point in time, the sheave assembly 110 assumes a passive role, no longer providing a mechanical advantage for lifting of the lift assembly 30. However, since the lift assembly 30 is now partially extended, the continued operation of the winch assembly 100 will cause the ends of the structural assemblies 40, 50, 60, 70, 80 and 90 to be drawn together further extending the lift assembly to a position such as in FIG. 1. As this is done, the sheave assembly 110 is lifted away from the base 10 disengaging the cam follower 118 and assuming the suspended position indicated in FIG. 1 and by the dotted lines in FIG. 5.

If the lift assembly 30 is then collapsed from the extended position of FIG. 1, the sheave assembly 110 reengages the follower 118 and by gravity forces rotates in a clockwise direction until it reassumes the totally collapsed position of FIG. 3 with the cable 101 disposed as shown therein for the next initiation of movement toward extended positions.

Figure 6:
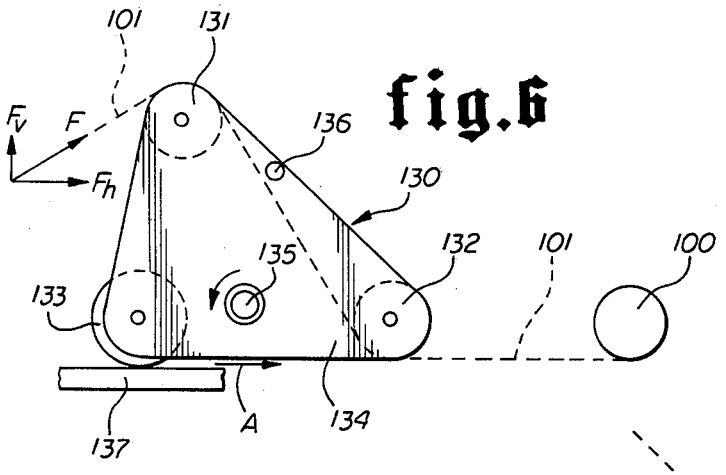
FIG. 6 is an elevation view of a mechanism for providing mechanical advantage in initiating movement of the elevatable scaffold of the present invention, according to an alternate embodiment thereof.
Figure 7:
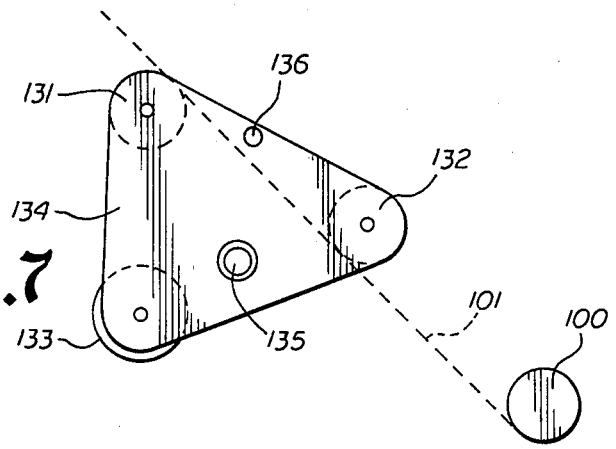
FIG. 7 is an elevation view of the alternate embodiment of FIG. 6, showing the relative position of the mechanism and cable when the scaffold is in the extended position of FIG. 1.

Referring now to FIGS. 6 and 7, an alternate embodiment of the invention is shown, utilizing a sheave assembly 130. Like in the previous embodiment, the sheave assembly 130 is mounted for rotation about a shaft 135 which is supported at the midpoint pivot between structural assemblies 40 and 50. This sheave assembly 130 also includes first and second sheave members 131 and 132 mounted for rotation between plates 134. Also mounted between plates 134 is a cam wheel 133 which in the collapsed position, illustrated in FIG. 6, rests against a rail 137 which may be attached to the base 10. The cable 101 passes from the winch assembly 100 around sheave 132 and 131 forcing a portion thereof to assume an inclined path from the sheave member 131 toward the sheave block 49 attached to the end of the structural assembly 40. As the cable is wound on the winch assembly 100 a force F is created having a vertical force component $F_v$ and a horizontal force component $F_h$ as indicated by the force diagram at the end of cable 101 in FIG. 6. The vertical force component $F_v$ is sufficient to initiate movement of the lift assembly 30 as with the previously described embodiment. As the cable 101 is wound on the winch assembly 100, the wheel 133 rides along the rail 137 as indicated by the arrow A, again forcing the shaft 135 and the structural assemblies 40 and 50 toward an extended position.

At a predetermined point, the cable 101 again assumes a straight line disposition between the winch assembly 100 and the sheave block 49 at the end of the structural assembly 40 as illustrated in FIG. 7. At this point, the sheave assembly 130 assumes a passive role and is lifted with the structural assemblies 40 and 50 as the lift assembly is further extended. To prevent the sheave assembly 130 from further pivoting about shaft 135, a retainer pin or roller 136 is provided between the plates 134 keeping the sheave 130 in essentially the same disposition as shown in FIG. 7 as the lift assembly 30 is further extended. Like in the previous embodiment, when the lift assembly 30 is moved again to the collapsed position of FIG. 2, the wheel 133 reengages the rail 137 moving in the opposite direction and repositioning the cable 101 as shown in FIG. 6 for the next initiation of movement of the lift assembly.

Thus, the elevatable scaffold of the present invention includes a base 10 and platform 20 connected therebetween by the lift assembly 30. The lift assembly 30 is movable from a collapsed position as shown in FIG. 2 to an extended position as shown in FIG. 1 for elevating the platform 20 above the base 10. The lift assembly 30 comprises a series of elongated structural assemblies 40, 50, 60, 70, 80, and 90, each pivoted at one end and the middle thereof to some other structural assembly in the series. The cable 101 passes substantially parallel with some of the structural assemblies and between the ends of mutually pivoted structural assemblies for securing of one end thereof at the platform 20 or at the end of one of the structural assemblies. The lift assembly also comprises a winch assembly 100 mounted on the base 10 and about which the other end of the cable is wound so that operation of the winch assembly 100 may effect elevating of the platform 20 by further winding of the cable 101 thereon.

Means are provided, engageable by the cable 101 when the lift assembly 30 is in its collapsed position, for creating a mechanical advantage in initiating the movement of the lift assembly toward extended positions. Whether the embodiment of FIGS. 3–5 or the embodiment of FIGS. 6 and 7 is utilized, the means for creating a mechanical advantage comprises a sheave assembly 110 or 130 mounted near the midpoint of one of the lowermost of the elongated structural assemblies and including at least one sheave member which is disposed above the base 10 and engageable by the cable 101, forcing a portion of the cable to assume an inclined path from the sheave member to one end of one of the lowermost of the elongated structural assemblies, to create a vertical force, upon operation of the winch assembly 100, to initiate movement of the lift structure from the collapsed position toward extended positions.

Thus, the elevatable platform of the present invention is self-propelled and elevatable by a winch and cable mechanism which is uniquely arranged to overcome movement initiation problems associated with winch and cable elevated scaffolds of the prior art. The resulting scaffold is relatively light, simple to manufacture and operate, and extremely usable in elevating workers or in lifting materials from the ground to an elevated position.

While at least two embodiments of the invention have been described herein, many other embodiments and variations of the invention can be made without departing from the spirit of the invention. Accordingly, it is intended that the scope of the invention be limited by the claims which follow.

I claim:

1. An elevatable scaffold including a base and a platform connected therebetween by a lift assembly movable between a collapsed position and extended positions for elevating said platform above said base, said lift assembly comprising:

a series of elongated structural assemblies each pivoted at one end and the middle thereof to some other structural assembly in said series;

a cable passing substantially parallel with some of said structural assemblies and between the ends of mutually pivoted structural assemblies, one end of said cable being secured near the end of one of said structural assemblies;

winch means mounted on said base and the other end of said cable wound thereon so that operation of said winch means may effect said elevating of said platform by further winding of said cable thereon; and means engageable by said cable when said lift assembly is in said collapsed position for providing a mechanical advantage in initiating the movement of said lift assembly toward said extended positions, comprising a sheave assembly mounted near the midpoint of one of the lowermost of said elongated structural assemblies and including at least first and second sheave members engageable by said cable between said winch means and one end of said one of the lowermost of said elongated structural assemblies, forcing a portion of said cable to assume an inclined path from said first sheave member toward said one end of said one of the lowermost of said elongated structural assemblies for creating a vertical force, upon operation of said winch means, to initiate movement of said lift structure from said collapsed position toward said extended positions.

2. An elevatable scaffold as set forth in claim 1 in which said sheave assembly is mounted for rotation about an axis allowing said cable to assume a straight line disposition upon movement of said lift structure to a predetermined extended position.

3. An elevatable scaffold as set forth in claim 1 in which said sheave assembly and said base are provided with cooperative cam and cam follower means mutually engageable upon operation of said winch means for effecting movement of said lift structure from said collapsed position to said predetermined extended position.

4. An elevatable scaffold as set forth in claim 3 in which said sheave assembly is attached to said one of the lowermost of said elongated structural assemblies near the midpoint thereof for rotation about said axis.

5. An elevatable scaffold as set forth in claim 4 in which said sheave assembly, upon movement of said lift structure to a more extended position than said predetermined extended position, is liftable above said base becoming inactive in providing said mechanical advantage.

6. An elevatable scaffold as set forth in claim 4 in which said sheave assembly comprises a pair of parallel plate members between which said first and second sheave members are mounted.

7. An elevatable scaffold as set forth in claim 1 in which each of said elongated structural assemblies comprises a pair of parallel elongated tong members, the ends of which are connected by header members, other sheave assemblies being attached to at least some of said header members for engagement by said cable between said winch means and the secured end of said cable.

8. An elevatable scaffold including a base and a platform connected therebetween by a lift assembly movable between a collapsed position and extended positions for elevating said platform above said base, said lift assembly comprising:

a series of elongated structural assemblies, each pivoted at one end and the middle thereof to some other structural assembly in said series;

a cable passing substantially parallel with some of said structural assemblies and between the ends of mutually pivoted structural assemblies, one end of said cable being secured near the end of one of said structural assemblies;

winch means mounted on said base and the other end of said cable wound thereon so that operation of said winch means may effect said elevating of said platform by pulling the ends of said mutually pivoted structural assemblies together upon further winding of said cable thereon; and a sheave assembly mounted near the midpoint of the lowermost of said mutually pivoted structural assemblies and including at least one sheave member disposed above said base and engageable by said cable forcing a portion of said cable to assume an inclined path from said sheave member toward one end of one of said mutually pivoted lowermost structural assemblies creating a vertical force, upon operation of said winch means, to initiate movement of said lift structure from said collapsed position toward said extended positions, said sheave assembly also including a pair of plate members between which said sheave member is mounted, said plate members having arcuate cam surfaces thereon engageable with a cam follower mounted on said base and by which said vertical force to initiate movement of said lift structure is effected.

9. An elevatable scaffold as set forth in claim 8 in which said plate members are rotatable about an axis parallel to the axis of said sheave member.

10. An elevatable scaffold as set forth in claim 9 in which said sheave assembly includes at least one other sheave member mounted between said plate members and below said first mentioned sheave member, when said lift structure is in said collapsed position, said cable engaging said other sheave member between said winch means and said first mentioned sheave member when said lift structure is in said collapsed position.

11. An elevatable scaffold as set forth in claim 9 in which said sheave assembly includes second, third and fourth sheave members engageable by said cable when said lift structure is in said collapsed position and effective upon said operation of said winch means for rotating and lifting the axis of said plate members while initiating said movement of said lift structure from said collapsed position toward said extended positions.

12. An elevatable scaffold as set forth in claim 11 in which said cable assumes a straight line position, between said winch means and said one end of said one of said mutually pivoted structural assemblies, upon movement of said lift structure to a predetermined extended position, relegating said sheave assembly to a passive role in further movement of said lift structure toward more extended positions.

13. An elevatable scaffold as set forth in claim 10 in which said cable assumes a straight line position, between said winch means and said one end of said one of said mutually pivoted structural assemblies, upon movement of said lift structure to a predetermined extended position, relegating said sheave assembly to a passive role in further movement of said lift structure toward more extended positions,

14. An elevatable scaffold as set forth in claim 13 in which said arcuate cam surfaces of said plate members are disengageable from said cam follower upon movement of said lift structure to said more extended positions.

15. An elevatable scaffold as set forth in claim 14 in which said arcuate cam surfaces of said plate members are reengageable with said cam follower upon unwinding of said winch means and consequent lowering of said lift structure below said predetermined extended position.

16. An elevatable scaffold as set forth in claim 15 in which said sheave assembly is rotatable about said axis of said plate members upon further lowering of said lift structure to said collapsed position until said cable assumes the same inclined path assumed prior to said movement of said lift structure from said collapsed position toward said extended positions.

* * * * *